US005443870A

United States Patent [19]

Lurie et al.

[11] Patent Number: 5,443,870

[45] Date of Patent: Aug. 22, 1995

[54] GOLF MAT TO SIMULATE COURSE CONDITIONS

[76] Inventors: Lewis Lurie, 393 Massapoag Ave., Sharon, Mass. 02067; James W. Lyman, 150 Hope St. #15, Stamford, Conn. 06906

[21] Appl. No.: 248,235

[22] Filed: May 24, 1994

[51] Int. Cl.[6] ..... A63B 57/00

[52] U.S. Cl. ..... 428/17; 273/176 J; 273/DIG. 13; 428/88

[58] Field of Search ..... 428/15, 17, 88; 273/DIG. 13, 176 J, 195 A

[56] References Cited

U.S. PATENT DOCUMENTS

| | | | |
|---|---|---|---|
| 3,735,988 | 5/1973 | Palmer et al. | 428/17 X |
| 3,740,303 | 6/1973 | Alderson et al. | 428/17 |
| 3,869,128 | 3/1975 | Ohashi | 273/195 A |
| 4,017,084 | 4/1977 | Jeffery | 428/17 X |
| 4,755,401 | 7/1988 | Friedrich et al. | 428/17 |
| 4,930,784 | 6/1990 | Jordan | 428/17 X |
| 5,131,658 | 7/1992 | Grenon | 273/180 |
| 5,356,344 | 10/1994 | Lemieux | 428/17 X |

*Primary Examiner*—Henry F. Epstein
*Attorney, Agent, or Firm*—Morgan & Finnegan

[57] ABSTRACT

A golf mat having an artificial grass area with a flat portion and a hill formed in the flat portion. The distance from the top of the hill to the top of the flat portion is at least one half of the length of the blades of grass that make up the grass surface. A second grass surface having grass shorter than that in the first grass surface is separated from the first grass surface by a grass-free area, suitable for advertising.

14 Claims, 3 Drawing Sheets

GOLF MAT TO SIMULATE COURSE CONDITIONS

FIELD OF THE INVENTION

The present invention relates to golf mats that enable a golfer to practice hitting a golf ball when he or she is unable to actually play on a golf course. More specifically, the invention relates to a mat that, among other things, allows a golfer to simulate uphill, sidehill and downhill lies.

Background of the Invention

Golf mats are widely used by golfers to practice hitting golf balls when the golfer is unable to play on a golf course. Driving ranges frequently use such mats, which usually have an artificial grass surface to simulate the grass on a golf course. The golfer places a ball on the simulated grass surface and then strikes the ball with a club, either into a net or into a common area where other golfers also hit.

Such mats are typically made from a hard weather resistant plastic material to provide long life out of doors. Although such mats are useful to aid the golfer in practice, the generally flat surfaces of the mats do not provide a realistic simulation of conditions on an actual golf course.

SUMMARY OF THE INVENTION

The disadvantages inherent in the prior art are overcome by the present invention which features a golf mat that has a surface which includes a substantially flat portion and a hill portion to enable the golfer to simulate uphill, downhill and sidehill lies.

In one embodiment, the improved golf mat of the present invention comprises a supporting surface and a plurality of artificial blades of grass of predetermined average height attached to the supporting surface to form an artificial grass surface on which a golf ball can be placed, the supporting surface having an elevated section which raises a first portion of the grass surface a predetermined distance above a second portion of the grass surface, the predetermined distance being equal to or greater than one half of the average height of the blades of grass.

The first portion is preferably the top of a hill formed in the mat and the second portion is a flat area that surrounds the hill. An inclined grass surface connects the first and second portions and provides a smooth transition therebetween. The grass in the first and second portions is preferably of approximately the same height and is about one and one half inches. The distance that the first portion is above the second portion is approximately one and one half inches and is preferably at least one half of the predetermined height of the blades of grass. The first (i.e., higher) portion of the grass surface is surrounded on at least three sides by the second (i.e., lower) portion.

A second artificial grass surface is formed by a second plurality of blades of grass attached to the supporting surface with the blades of grass in this section having an average height less than that of the predetermined average height (i.e., less than the height of the blades of grass that make up the first surface) and preferably about 0.375 inches. The first and second artificial grass surfaces can be separated by an area that has no attached grass.

DETAILED DESCRIPTION OF A PREFERRED EMBODIMENT

Figure 1:
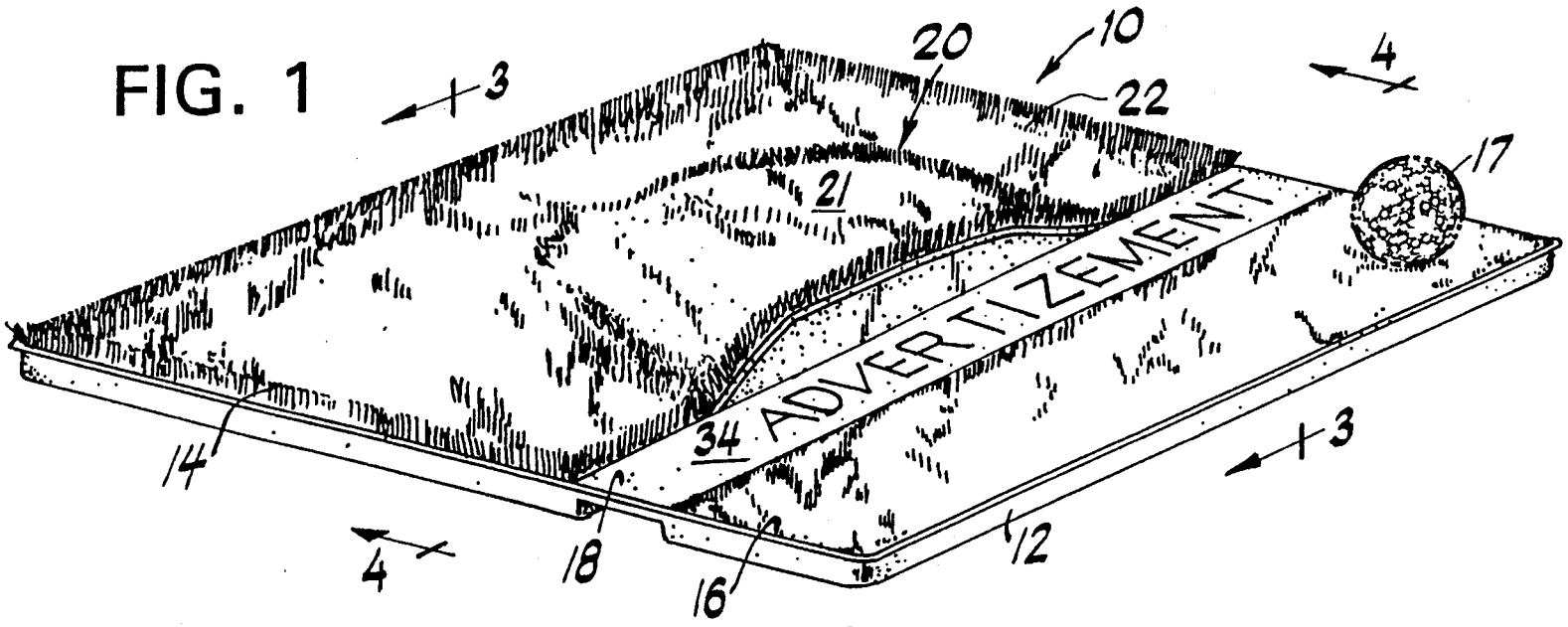
FIG. 1 is a perspective view of a golf mat according to one embodiment of the invention.

Referring to FIG. 1, a golf mat 10 is illustrated and includes a supporting tray 12 to which first and second artificial grass surfaces 14, 16, are attached. Each artificial grass surface is formed from a plurality of blades of grass, with grass surface 14 having larger blades of grass than surface 16. A flat rectangular region 18 separates grass surfaces 14, 16 and has no attached grass.

Grass surface 14 includes a "hill" 20 and a flat lower portion 22. Hill 20 has an upper surface 21 that is above the upper surface of the lower portion 22. Lower portion 22 surrounds hill 20 on three sides with the fourth side of hill 20 being bordered by region 18. Grass surface 16 is substantially flat throughout. A golf ball 17 is shown positioned on grass surface 16.

Figure 2:
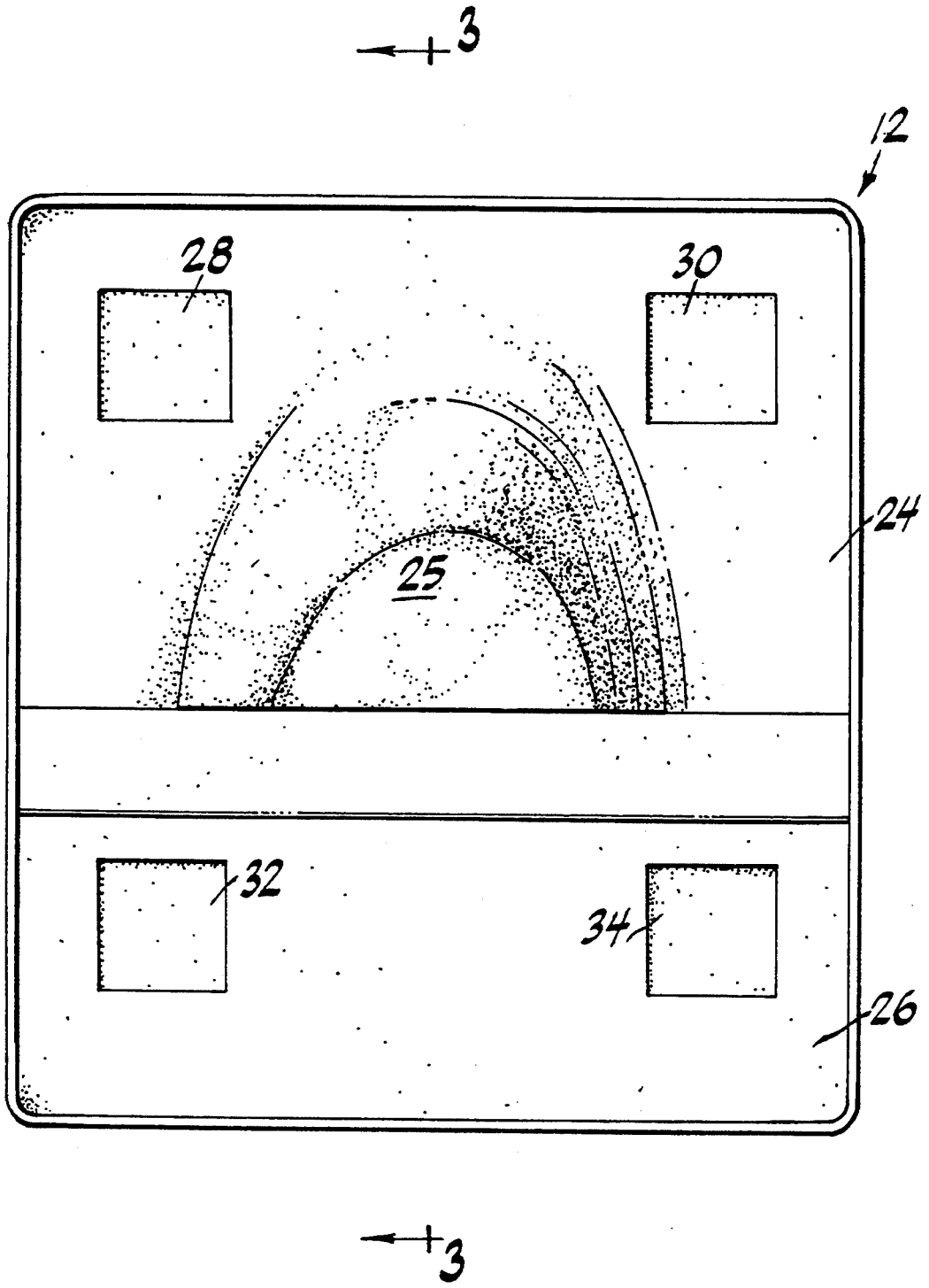
FIG. 2 is an overhead view of a supporting tray shown in FIG. 1 to which the artificial grass surface shown in FIG. 1 is attached.

An overhead view of supporting tray 12 is shown in FIG. 2 with the artificial grass surfaces removed. (Note that like numerals represent like elements throughout the figures.) Tray 12 is formed from a hard plastic material and includes two surfaces 24, 26 which receive the grass that make up grass surfaces 14, 16, respectively (see FIG. 1). Surface 24 includes a hill 25 which will facilitate the creation of grass hill 20 when the artificial grass is attached to the supporting tray. Surface 26 is substantially flat.

Four recessed portions 28, 30, 32 and 34 are formed in supporting tray 12 as shown. These recessed portions form four feet on the bottom of supporting tray 12.

Figure 3:
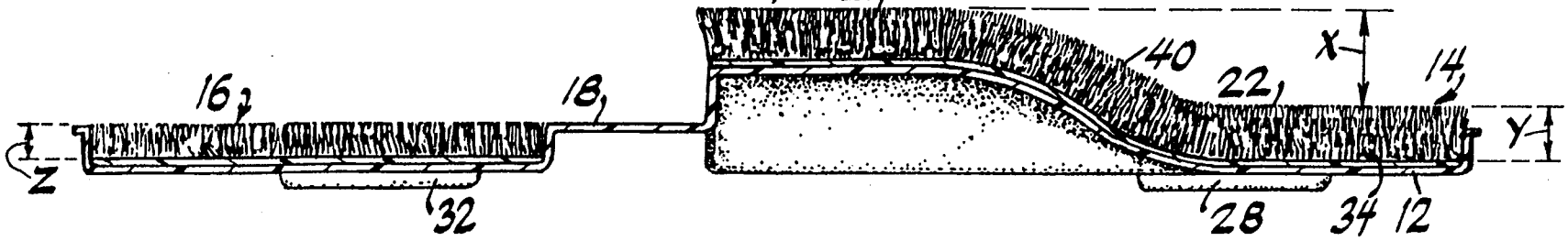
FIG. 3 is a cross-sectional view of the golf mat shown in FIG. 1.

FIG. 3 is a cross-sectional view taken along line 3—3 in FIG. 1. The blades of grass that make up surfaces 14, 16 are formed of a polypropylene, and are attached to supporting urethane surfaces 34, 36. Each supporting surface 34, 36 is attached to tray 12 by an adhesive. One preferred adhesive is sold under the tradename Mid-South #6400. A smooth inclined surface 40 connects surface 22 with the top of hill 20.

Figure 4:
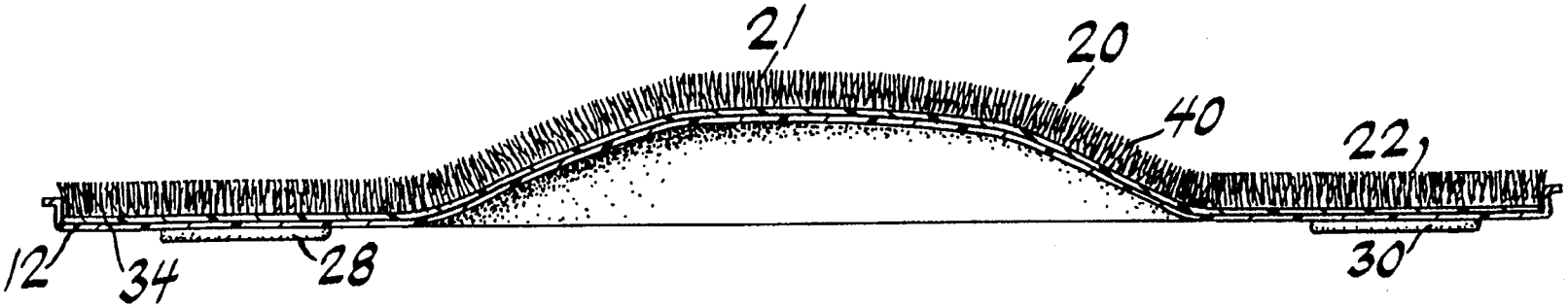
FIG. 4 is a second cross-sectional view of the golf mat shown in FIG. 1.

FIG. 4 is a second cross-sectional view of the tray shown in FIG. 1, taken along line 4—4. The components in this figure are as described above.

Although the blades of grass are shown in all of the figures as pointing straight up in the air, in practice, depending on the length of the blades, the blades may tend to bend over much like real grass. This effect enhances the similarity to real golf course conditions. One company that makes suitable artificial grass surfaces for use with this invention is Playfield International, Inc. of Dallas, Tex.

In order to accurately simulate different lies that are likely to be encountered on a golf course, certain dimensional relationships are practiced in the preferred embodiment of the invention. Referring to FIG. 3, the height of the blades of grass that make up surface 14 is represented by the letter y and is preferably about 1.5 inches. The height of the blades of grass that make up surface 16 is represented in FIG. 3 by the letter z and is preferably about 0.375 inches. (Note that these dimensional measurements are made assuming the blades of grass are standing vertically.)

The distance between surface 22 and surface 21 of hill 20 is represented by x. It has been determined by the inventors that for optimal results, x should be about equal to y and is at least 50% of y. In the preferred embodiment x is therefore about 1.5 inches and at least 0.75 inches. It has also been determined that the optimal angle for inclined surface 40 varies between ten and forty degrees and is preferably about twenty degrees. (The angle is measured between upper surface 21 and a tangent to the midpoint of surface 40.)

Using the golf mat of the present invention a golfer can practice uphill lies, downhill lies and sidehill lies. For example, if a right handed golfer positions the mat of FIG. 1 such that surface 14 is closer to him than surface 16, and he positions a golf ball on the left side of hill 20 he can practice downhill lies. By positioning the ball on the right side of hill 20 uphill lies can be practiced. If the ball is placed on the side of hill 20 closest to the golfer then sidehill lies can be practiced.

Since grasses of different heights are used, the golfer can also practice fairway shots by putting his ball on surface 16, or can practice "rough" shots by putting the ball on surface 14. Thus, a wide variety of different golf situations can be accurately simulated using the present invention.

It should be noted that the above description is a preferred example of the invention only and modifications may be made as will be understood by those skilled in the art. For example, the height of the grass can be varied as can the overall shape of the mat. A circular golf mat may be preferred for some applications and the location of hill 20 can be altered. It may also be desirable to have more than one hill 20.

Flat portion 18 serves to separate the two grass surfaces, but is not essential and can be eliminated completely. Surface 18 is also ideal for placement of a corporate logo or other advertisement. A number of holes can be placed through the mat to allow a user to secure the mat to the ground with stakes. Also, a rubber tee can be placed on the mat to practice tee shots, the tee preferably being located in area 16.

Other changes are within the scope of the appended claims.

We claim:

1. A golf mat for simulating conditions on a golf course comprising:

a supporting surface; and a plurality of artificial blades of grass attached to said supporting surface to form an artificial grass surface on which a golf ball can be placed;

wherein said supporting surface comprises an elevated section which raises a first portion of said grass surface a predetermined distance above a second portion of said grass surface, said first portion of said grass surface being connected to said second portion of said grass surface by an inclined grass surface having blades of grass that have an average height of at least three quarters of one inch.

2. The golf mat of claim 1 wherein said inclined grass surface has blades of grass that have an average height of at least one inch.

3. The golf mat of claim 2 wherein the midpoint of said inclined surface forms an angle of about twenty degrees with said first portion of said grass surface.

4. The golf mat of claim 1 wherein the midpoint of said inclined surface forms an angle of more than ten degrees and less than forty degrees with said first portion of said grass surface.

5. The golf mat of claim 1 wherein said inclined grass surface provides a smooth transition between said first portion of said grass surface and said second portion of said grass surface.

6. The golf mat of claim 1 wherein said average height of said blades of grass is approximately one and one half inches.

7. The golf mat of claim 6 wherein said predetermined distance is approximately one and one half inches.

8. The golf mat of claim 1 wherein said first portion is surrounded on at least three sides thereof by said second portion.

9. The golf mat of claim 1 further comprising a second artificial grass surface formed by a second plurality of blades of grass attached to said supporting surface, said second plurality of blades of grass having an average height less than that of said average height of said blades of grass on said inclined surface.

10. The golf mat of claim 1 wherein said artificial blades of grass are all approximately the same height.

11. The golf mat of claim 1 wherein said predetermined distance is at least equal to said average height.

12. The golf mat of claim 1 further comprising a second artificial grass surface formed by a second plurality of blades of grass attached to said supporting surface, said second plurality of blades of grass being separated from said first plurality of blades of grass by a grass free surface.

13. The golf mat of claim 12 wherein said grass free surface contains a printed advertisement.

14. The golf mat of claim 1 wherein said predetermined distance is at least three quarters of said average height.

* * * * *